US011072928B2

(12) United States Patent
Miller et al.

(10) Patent No.: US 11,072,928 B2
(45) Date of Patent: Jul. 27, 2021

(54) THERMALLY ADAPTIVE GLAZING PANEL ROOFING SYSTEM

(71) Applicant: Duo-Gard Industries, Inc., Canton, MI (US)

(72) Inventors: David Miller, Plymouth, MI (US); Frank Kosciolek, Redford, MI (US)

(73) Assignee: Duo-Gard Industries, Inc., Canton, MI (US)

( * ) Notice: Subject to any disclaimer, the term of this patent is extended or adjusted under 35 U.S.C. 154(b) by 0 days.

(21) Appl. No.: 16/834,301

(22) Filed: Mar. 30, 2020

(65) Prior Publication Data

US 2020/0308836 A1 Oct. 1, 2020

Related U.S. Application Data

(60) Provisional application No. 62/825,370, filed on Mar. 28, 2019.

(51) Int. Cl.
*E04D 3/06* (2006.01)

(52) U.S. Cl.
CPC ..... *E04D 3/06* (2013.01)

(58) Field of Classification Search
CPC ... E04D 3/06; E04D 3/362; E04D 2003/3615; E04D 2003/285; E04C 2002/004; E04C 2/54
See application file for complete search history.

(56) References Cited

U.S. PATENT DOCUMENTS 4,819,405 A * 4/1989 Jackson ..... E06B 3/677 52/795.1
2007/0251183 A1* 11/2007 Thiagarajan ..... E04D 3/32 52/590.1
2015/0308126 A1* 10/2015 Kugler ..... E04B 5/023 52/506.06
2017/0146321 A1* 5/2017 Bertolini ..... B60J 1/08
2018/0217319 A1* 8/2018 Eyme ..... E04B 2/7401
2019/0376282 A1* 12/2019 Michel ..... E04B 2/7455

* cited by examiner

*Primary Examiner* — Patrick J Maestri
(74) *Attorney, Agent, or Firm* — Quinn IP Law

(57) ABSTRACT

A thermally adaptive glazing panel roofing system is provided. The system includes a glazing panel including at least one notch formed in a side of the glazing panel, two side brackets each including a ledge feature. Opposite sides of the glazing panel are supported by the ledge features. The system further includes at least one panel support plate attached to one of the ledge features and engaged to the notch. The system further includes a first pressure cap affixed to a first side bracket of the two side brackets and a second pressure cap affixed to a second side bracket of the two side brackets. The glazing panel is operable to thermally expand along the ledge features.

16 Claims, 8 Drawing Sheets

THERMALLY ADAPTIVE GLAZING PANEL ROOFING SYSTEM

CROSS-REFERENCE TO RELATED APPLICATIONS

This application claims the benefit of U.S. Provisional Patent Application No. 62/825,370 filed on Mar. 28, 2019, the disclosure of which is hereby incorporated by reference.

INTRODUCTION

The disclosure generally relates to a thermally adaptive glazing panel roofing system.

Glazing panels are known for roofing applications. In some embodiments, glazing panels may be described as monolithic panels. They may be suspended over an area to provide roofing. Glazing panels may be transparent or translucent, are frequently made of polymerized materials, and allow light to pass through the roofing into the area being covered.

Some systems to secure glazing panels may grip two sides of a rectangular shaped glazing panel. Other systems may utilize a parallelogram-shaped glazing panel or other similar shape.

Glazing panels are also known to be gripped on two sides within pressure retention members. Such retention members typically clamp down upon an entire side or entire length of an elongated panel.

SUMMARY

Polymerized glazing panels used in roofing systems are subject to wide changes in temperatures. In a space of one day, a glazing panel in the middle of the night may experience freezing temperatures. The same glazing panel, being exposed to full sunlight from above and neighboring thermal insulation from below, may experience temperatures well over 120° F. Polymerized panels expand and contract significantly depending upon temperature. As a result, a polymerized panel used in a roofing system is subject to buckling, waviness, cracks, stress fractures, and eventual failure from thermal cycling.

A thermally adaptive glazing panel roofing system is provided. The system includes a glazing panel including at least one notch formed in a side of the glazing panel, two side brackets each including a ledge feature. Opposite sides of the glazing panel are supported by the ledge features. The system further includes at least one panel support plate attached to one of the ledge features and engaged to the notch. The system further includes a first pressure cap affixed to a first side bracket of the two side brackets and a second pressure cap affixed to a second side bracket of the two side brackets. The glazing panel is operable to thermally expand along the ledge features.

In some embodiments, the glazing panel includes two notches formed on the opposite sides of the glazing panel. In some embodiments, the system further includes a pair of panel support plates engaged to the two notches.

In some embodiments, the two notches are formed at a bottom of the opposite sides of the glazing panel.

In some embodiments, the two notches are formed at a center portion of the opposite sides of the glazing panel.

In some embodiments, the glazing panel includes a first glazing panel, and the first glazing panel includes a first pair of notches formed on the opposite sides of the first glazing panel. In some embodiments, the system further includes a first pair of panel support plates attached to the ledge features and engaged to first pair of notches, a second glazing panel including a second pair of notches formed on opposite sides of the second glazing panel, and a second pair of panel support plates attached to the ledge features and engaged to first pair of notches.

In some embodiments, the first glazing panel includes a first cut-out portion along a bottom edge of the first glazing panel, the second glazing panel includes a second cut-out portion along a top edge of the second glazing panel, and the first cut-out portion and the second cut-out portion are operable to overlap and to maintain an intact roofing surface while permitting the second rectangle-shaped glazing panel to thermally expand.

In some embodiments, the first glazing panel is operable to thermally expand in a direction away from the second glazing panel In some embodiments, the glazing panel is rectangle-shaped.

According to one alternative embodiment, a thermally adaptive glazing panel roofing system is provided. The system includes a first rectangle-shaped glazing panel including a first pair of notches formed in opposite sides of the first glazing panel, a second rectangle-shaped glazing panel including a second pair of notches formed in opposite sides of the second glazing panel, and two side brackets, each including a ledge feature. Opposite sides of the first rectangle-shaped glazing panel are supported by the ledge features. Opposite sides of the second rectangle-shaped glazing panel are supported by the ledge features. The system further includes a first pair of panel support plates, each attached to one of the ledge features and each engaged to one of the first pair of notches, and a second pair of panel support plates, each attached to one of the ledge features and each engaged to one of the second pair of notches. The system further includes a first pressure cap affixed to a first side bracket of the two side brackets and a second pressure cap affixed to a second side bracket of the two side brackets. The first rectangle-shaped glazing panel is disposed at a relatively higher position upon the two side brackets as compared to the second rectangle-shaped glazing panel. At least one of the first glazing panel and the second glazing panel is operable to thermally expand along the ledge features.

In some embodiments, the first glazing panel and the second glazing panel are operable to thermally expand along the ledge features.

In some embodiments, the first pair of notches are formed at a bottom of the opposite sides of the first glazing panel.

In some embodiments, the second pair of notches are formed at a bottom of the opposite sides of the second glazing panel.

In some embodiments, the first pair of notches are formed at a center portion of the opposite sides of the first glazing panel.

In some embodiments, the second pair of notches are formed at a center portion of the opposite sides of the second glazing panel.

In some embodiments, the first glazing panel includes a first cut-out portion along a bottom edge of the first glazing panel. In some embodiments, the second glazing panel includes a second cut-out portion along a top edge of the second glazing panel, and the first cut-out portion and the second cut-out portion are operable to overlap and to maintain an intact roofing surface while permitting the second rectangle-shaped glazing panel to thermally expand.

The above features and advantages and other features and advantages of the present disclosure are readily apparent from the following detailed description of the best modes for carrying out the disclosure when taken in connection with the accompanying drawings.

DETAILED DESCRIPTION

A thermally adaptive glazing panel roofing system is provided. A glazing panel may include a flat, polymer or plastic sheet. The glazing panel may be transparent, translucent, or opaque. Throughout the disclosure, the glazing panel may alternatively be described as a monolithic panel. The glazing panel is substantially rectangular in shape, with two relatively longer edges and with two relatively shorter edges. The relatively longer edges may be supported by a side bracket along each relatively longer edge, with the side brackets arranged parallel to the length of the glazing panel. The side brackets 20, the glazing panel 40 and the glazing panel 50 may be laid flat or may be angled in accordance with a roof surface, for example, slanted at some angle relative to a flat ground surface.

Figure 1:
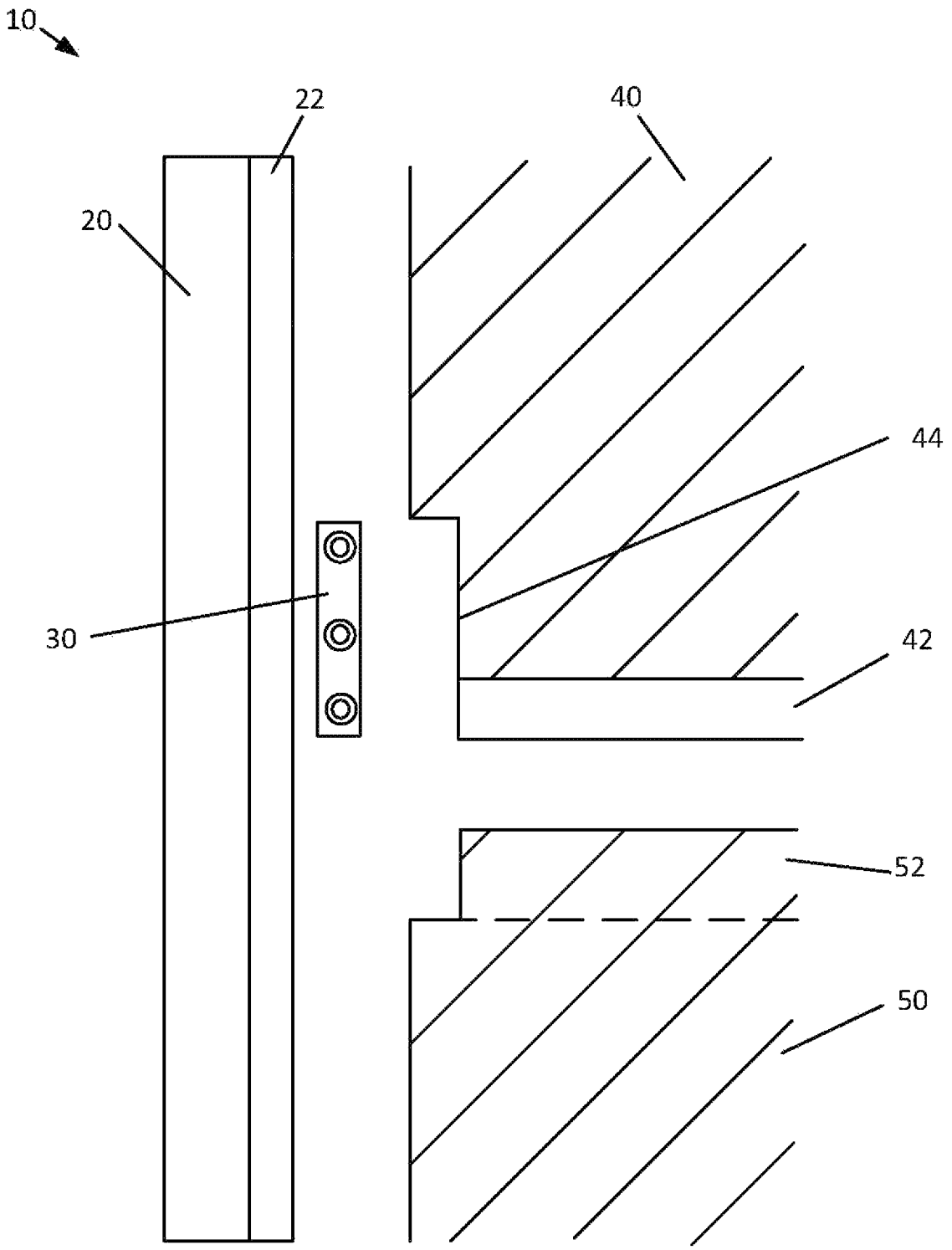
FIG. 1 schematically illustrates components of an exemplary thermally adaptive glazing panel roofing system, the components in a disassembled state, in accordance with the present disclosure.

Referring now to the drawings, wherein the showings are for the purpose of illustrating certain exemplary embodiments only and not for the purpose of limiting the same, FIG. 1 illustrates components of an exemplary thermally adaptive glazing panel roofing system 10, the components of the system illustrated in a disassembled state. A first glazing panel 40 and a second glazing panel 50 are illustrated, along with a side bracket 20 and a panel support plate 30. The glazing panel 40 and the glazing panel 50, when assembled to the side bracket 20, are supported by and rest upon a ledge feature 22 of the side bracket 20. A second side bracket 20 may be used to support a second side of the glazing panels (second side bracket 20 not shown.) The side bracket 20 may be mounted to a roofing surface at some angle, for example, 30 to 60 degrees, according to roofing angles in the art, with a top of the side bracket 20 approaching an apex of the roof and a bottom of the side bracket 20 approaching a lowest portion of the roof, and the glazing panel 40 and the glazing panel 50 are installed between two of the side brackets 20. Gravity would cause the glazing panel 40 and the glazing panel 50 to fall down, except that the panel support plate 30 is fastened to the side bracket 20, and the notch 44 of the glazing panel 40 fits around the panel support plate 30 and provides support to the glazing panel 40, preventing it from falling down. However, the glazing panel 40 rests upon the panel support plate 30 and the ledge feature 22, thereby permitting portions of the glazing panel 40 to slide against the side bracket 20 as the glazing panel 40 expands and contracts due to thermal variation.

The thermally adaptive glazing panel roofing system 10 is illustrated with two exemplary glazing panels, the glazing panel 40 and the glazing panel 50. Glazing panels may be a wide variety of lengths, for example, ten or twenty feet long, such that the glazing panel 40 and the glazing panel 50 may be used with an exemplary embodiment of the side bracket 20 that is forty feet in length or a plurality of shorter examples of the side bracket 20 that are aligned end to end to span the overall exemplary length of forty feet. A plurality of glazing panels may similarly be utilized, for example, with twenty glazing panels arranged end to end covering a large warehouse, concourse, or hangar-type building. Widths of the glazing panel 40 and the glazing panel 50 may vary. According to one embodiment, the glazing panels may be two feet wide. Other widths may be alternately utilized in accordance with the disclosure. The values provided for glazing panel and side bracket dimensions are exemplary, length and width values may be larger or smaller than the ranges provided, and the disclosure is not intended to be limited to the examples provided herein.

The glazing panel 40 and the glazing panel 50 each include optional mating cut-out portion 42 and cut-out portion 52, respectively, permitting the panels to have overlapping tabs when the panels overlap each other. In this way, the glazing panel 40 and the glazing panel 50 may be permitted to thermally expand, changing overall length dimensions, while still covering the span between opposing side brackets 20.

Figure 2:
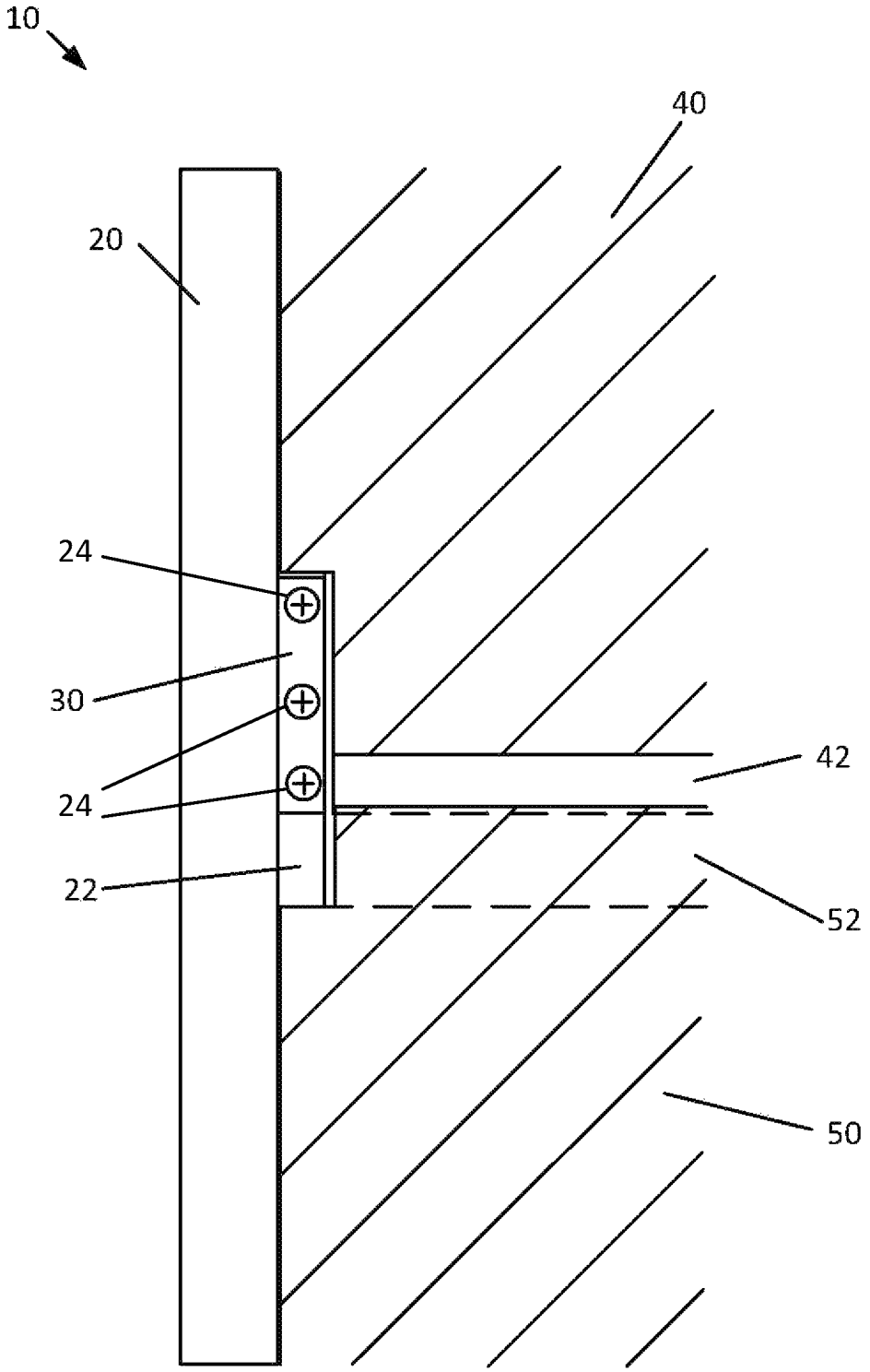
FIG. 2 schematically illustrates the thermally adaptive glazing panel roofing system of FIG. 1 in an assembled state, with the glazing panels being in a cooler, contracted state, in accordance with the present disclosure.

FIG. 2 illustrates the thermally adaptive glazing panel roofing system 10 of FIG. 1 in an assembled state, with the glazing panel 40 and the glazing panel 50 being in a cooler, contracted state. The side bracket 20 is illustrated, with the ledge feature 22 and the panel support plate 30 providing support to the glazing panel 40. The panel support plate 30 is secured to the ledge feature 22 with three self-tapping screws 24. The glazing panel 50 is additionally illustrated, mounted below the panel support plate 30. A gap exists between the glazing panel 40 and the glazing panel 50, with the cut-out portion 42 and the cut-out portion 52 slightly overlapping each other. The roof may remain continuous with the cut-out portion 42 and the cut-out portion 52 overlapping, although a gap between features of the glazing panel 40 and the glazing panel 50 exist, such that the two panels may thermally expand toward each other without buckling. When the glazing panel 40 and the glazing panel 50 are exposed to higher temperatures and expand, the glazing panel 50 may expand into the gap in features between the glazing panel 40 and the glazing panel 50 without causing the panels to buckle or distort against each other.

Figure 3:
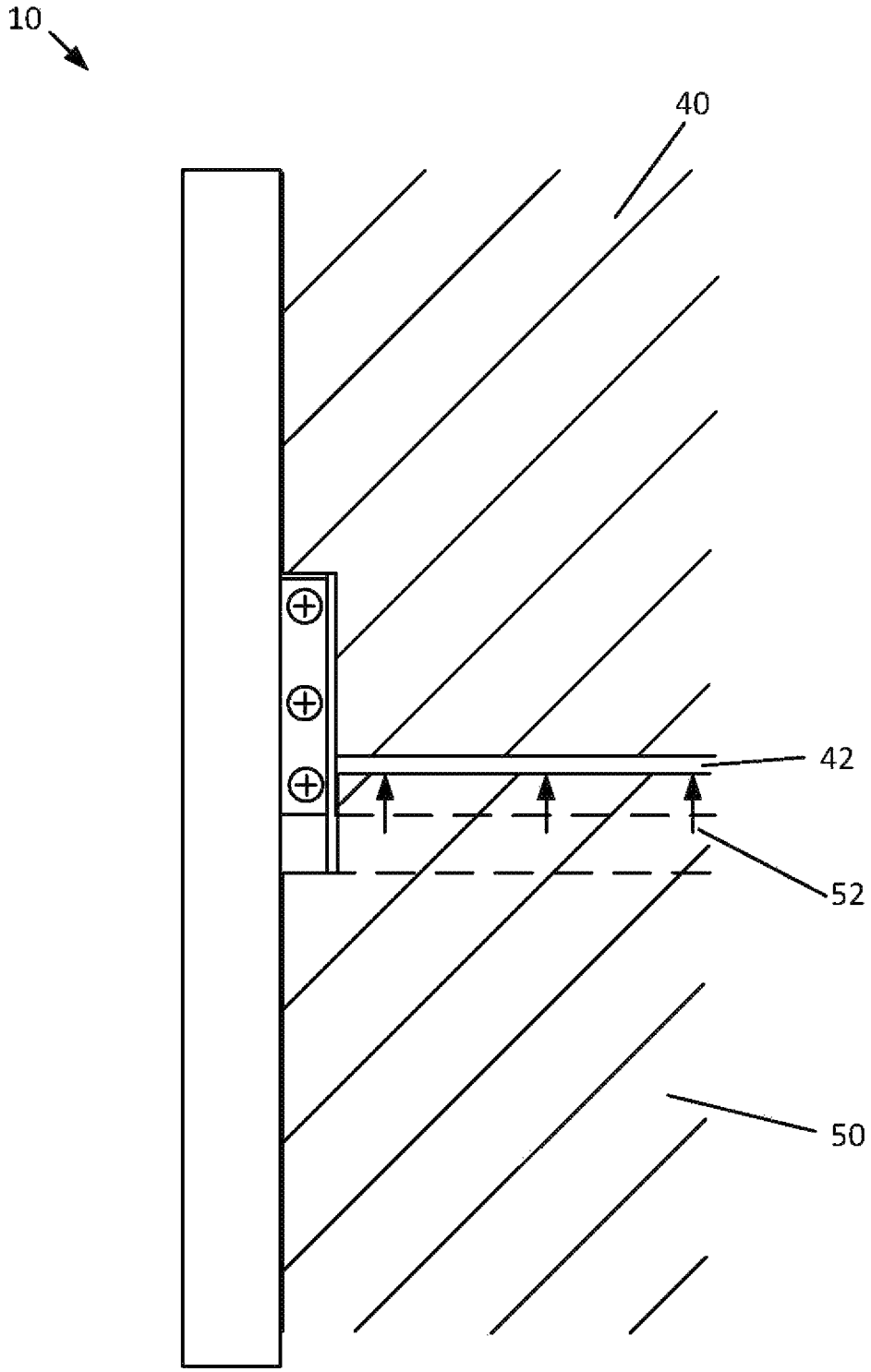
FIG. 3 schematically illustrates the thermally adaptive glazing panel roofing system of FIG. 2, with the glazing panels being in a warmer, expanded state, in accordance with the present disclosure.

FIG. 3 illustrates the thermally adaptive glazing panel roofing system 10 of FIG. 2, with the glazing panels being in a warmer, expanded state. The glazing panel 40 and the glazing panel 50 are illustrated, with the cut-out portion 42 and the cut-out portion 52 significantly overlapping, with arrows illustrating a direction in which the glazing panel 50 expanded due to higher temperatures.

Figure 4:
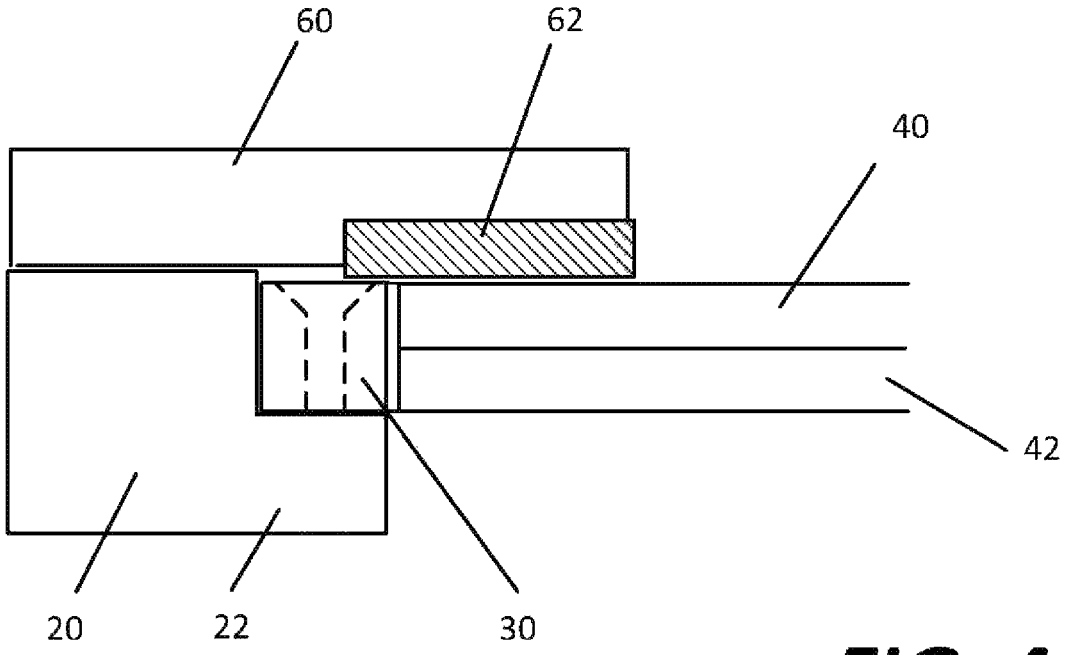
FIG. 4 schematically illustrates the thermally adaptive glazing panel roofing system of FIG. 2 in cross section from an end view of a glazing panel, in accordance with the present disclosure.

FIG. 4 illustrates the thermally adaptive glazing panel roofing system 10 of FIG. 2 in cross section. While the glazing panel 40 and the glazing panel 50 rest upon the ledge feature 22 and the panel support plate 30 as illustrated in FIGS. 1-3, a pressure cap 60 is illustrated in FIG. 4, installed over a top of the side bracket 20 and the glazing panel 40, holding the glazing panel 40 in place, seated against the ledge feature 22. Without the pressure cap 60 in place, wind, snow, seismic activity, thermal movement, or other dead and live loads could dislodge the glazing panel 40 from the ledge feature 22 and cause the panel to fall. The pressure cap 60 may be a single metallic piece or elongated strip. A rubberized gripper strip 62 is illustrated installed to the pressure cap 60 to enable a cushioned grip upon the glazing panel 40. The pressure cap 60 may hold the glazing panel 40 against the ledge feature 22 without preventing portions of the glazing panel 40 to slide against the ledge feature 22 as a result of thermal expansion or contraction, thereby permitting the glazing panel 40 and other panels, such as the glazing panel 50 of FIG. 3, to slide against the side bracket 20 and the pressure cap 60.

Figure 5:
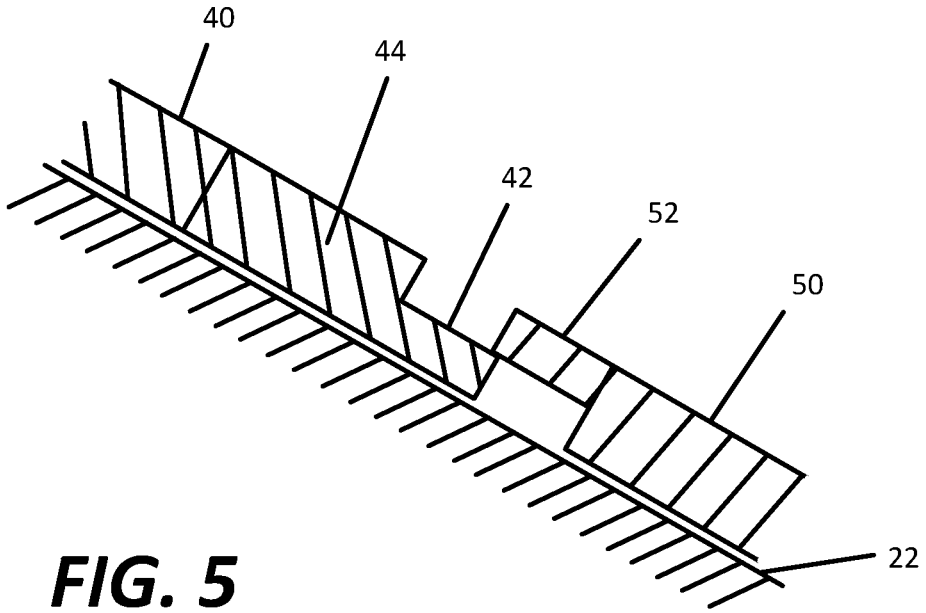
FIG. 5 schematically illustrates the thermally adaptive glazing panel roofing system of FIG. 2 in cross section from a side view of two glazing panels, in accordance with the present disclosure.

FIG. 5 schematically illustrates in side sectional view the glazing panel 40 and the glazing panel 50. The glazing panel 40 and the glazing panel 50 each rest upon the ledge feature 22. The notch 44 is illustrated which interacts with the panel support plate 30 (not shown.) The cut-out portion 42 and the cut-out portion 52 are illustrated overlapping, such that the ceiling surface provided by the glazing panel 40 and the glazing panel 50 is intact.

Figure 6:
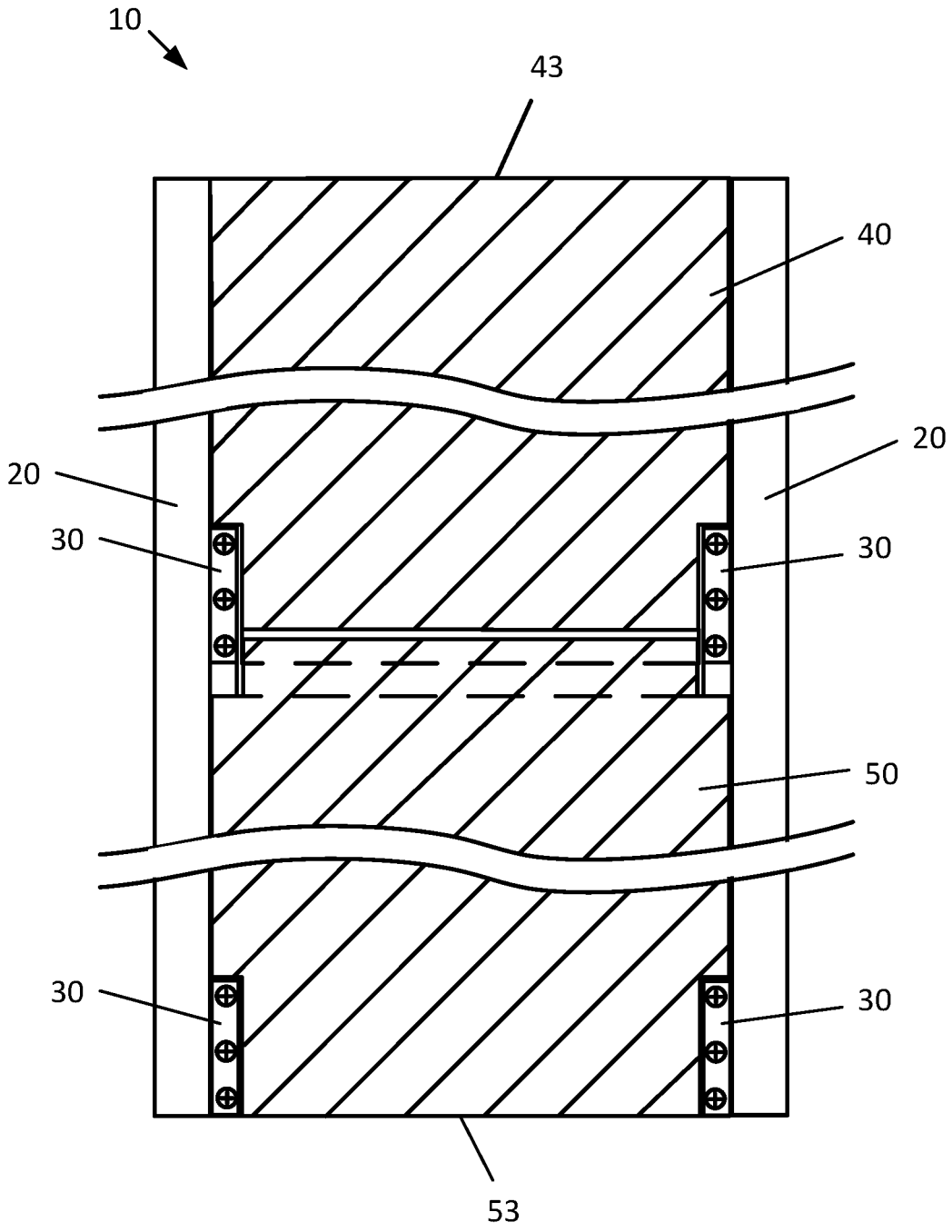
FIG. 6 schematically illustrates the thermally adaptive glazing panel roofing system of FIG. 3 including a first top end of the first glazing panel and a second bottom end of the second glazing panel, in accordance with the present disclosure.

FIG. 6 schematically illustrates the thermally adaptive glazing panel roofing system 10 of FIG. 2, illustrating the system including both of the side brackets 20, a top portion 43 of the glazing panel 40, and a bottom portion 53 of the glazing panel 50. Two panel support plates 30 are illustrated fastened to the side brackets 20 supporting the glazing panel 40, and additionally two panel support plates 30 are illustrated fastened to the side brackets 20 supporting the glazing panel 50. Based upon being supported by the panel support plates 30 and the side brackets 20, both the glazing panel 40 and the glazing panel 50 may thermally expand in a direction toward a top of each of the glazing panels.

Figure 7:
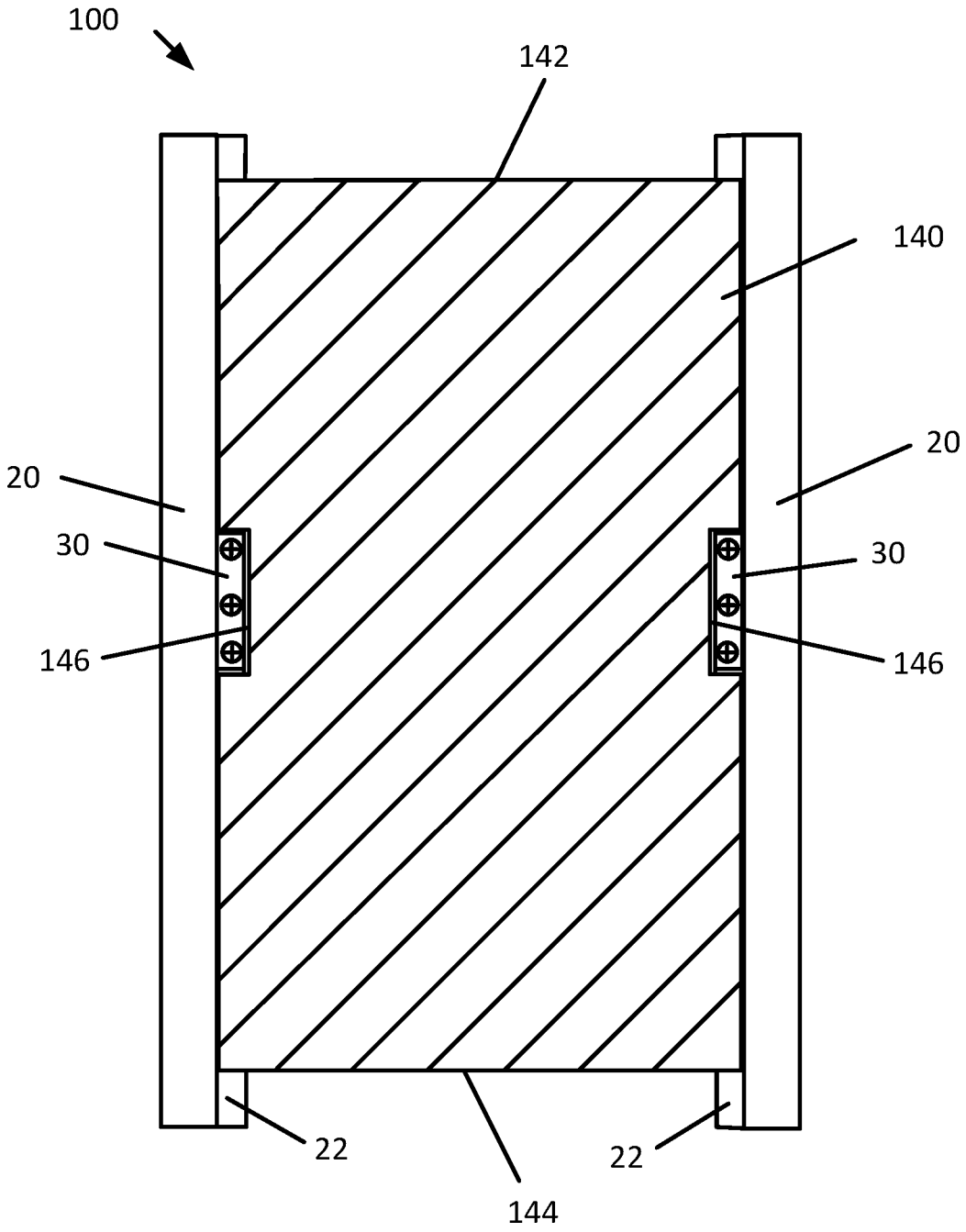
FIG. 7 schematically illustrates an alternative exemplary embodiment of a thermally adaptive glazing panel roofing system, in accordance with the present disclosure.

FIG. 7 schematically illustrates an exemplary alternative embodiment for a thermally adaptive glazing panel roofing system 100. A glazing panel 140 is illustrated including two notches 146, one on each side of the glazing panel 140, operable to engage with two panel support plates 30 in a center portion of the glazing panel 140. The notches 146 and the corresponding panel support plates 30 may be located at any location along the sides of the glazing panel 140. The glazing panel 140 is supported along the sides by ledge features 22 of the side brackets 20. By engaging the glazing panel 140 in the center portion, thermal expansion may cause approximately a top half of the glazing panel 140 to expand upward toward an upper end 142 of the glazing panel 140. Additionally, thermal expansion may cause approximately a bottom half of the glazing panel 140 to expand downward toward a lower end 144 of the glazing panel 140. In some embodiments, a plurality of glazing panels 140 may be utilized end to end. In some embodiments, ends of glazing panel 140 may include a cut-out portion configured to overlap with a mating cut-out portion on a neighboring glazing panel 140.

Figure 8:
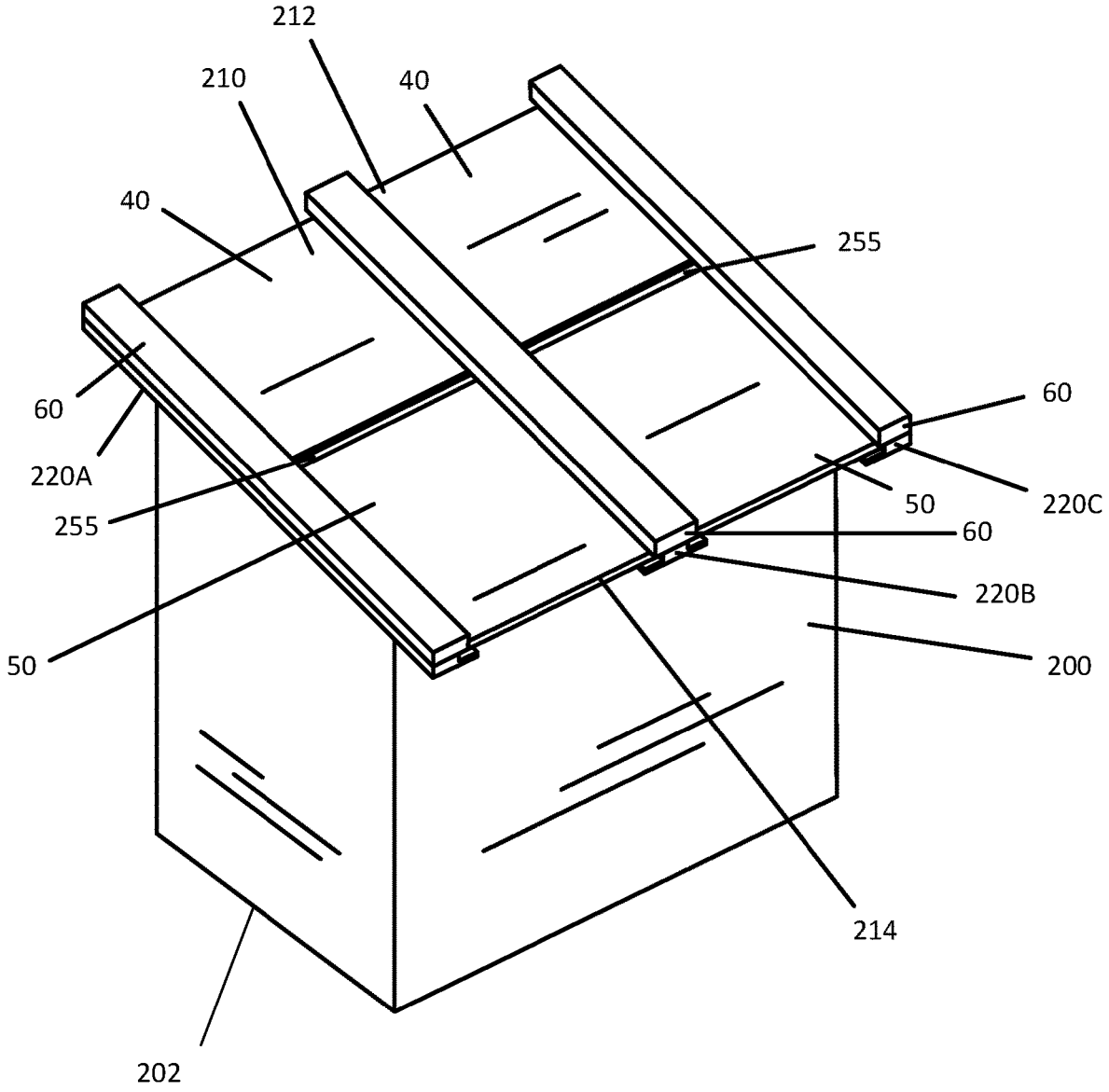
FIG. 8 illustrates an exemplary embodiment of a thermally adaptive glazing panel roofing system installed to a structure.

FIG. 8 illustrates a thermally adaptive glazing panel roofing system 210 installed to a structure 200. Structure 200 may include any structure, including but not limited to commercial buildings, retail shops, warehouses, bus stops, canopies, walkways, or other similar buildings. The exemplary thermally adaptive glazing panel roofing system 210 is illustrated including a single planar roof surface. It will be appreciated that more complex shapes can be constructed, for example, with two planar roof surfaces meeting at a ridge. In such an example, an angled ridge cap may be placed over a top of top edges of the glazing panels and used to span the tops of the glazing panels. Structure 200 includes a flat bottom surface 202. The planar roof surface of the thermally adaptive glazing panel roofing system 210 may form an angle with respect to the flat bottom surface 202, such that rain will flow off of the planar roof surface. The thermally adaptive glazing panel roofing system 210 includes a top portion 212 and a bottom portion 214. The thermally adaptive glazing panel roofing system 210 includes two glazing panels 40 and two glazing panels 50. The glazing panels 40 each meet with one of the glazing panels 50 at a panel overlap portion 255. As the glazing panels 50 thermally expand, the panels expand into the panel overlap portion 255. The glazing panels 40 and the glazing panels 50 are each held in place between either a side bracket 220A and a side bracket 220B or the side bracket 220B and a side bracket 220C. Each of the glazing panels 40 and the glazing panels 50 may be supported by ledge features of the side bracket 220B and the side bracket 220A or the side bracket 220C. Each of the glazing panels 40 and the glazing panels 50 may be additionally supported by panel support plates (not shown) affixed to the side brackets. Each of the glazing panels 40 and the glazing panels 50 may be held in place by a pair of pressure caps 60 affixed to tops of the side bracket 220B and the side bracket 220A or the side bracket 220C. A number of roof configurations utilizing the disclosed thermally adaptive glazing panel roofing system are envisioned, and the disclosure is not intended to be limited to the examples provided herein.

Glazing panels may be constructed of many different materials, including but not limited to polycarbonate, plastics, acrylics, glass, wood, aluminum, and steel. Side brackets, panel support plates, and pressure caps may be constructed of many different materials, including but not limited to aluminum and steel of different elemental and alloy percentages, wood, plastics, acrylics, and polycarbonates.

While the best modes for carrying out the disclosure have been described in detail, those familiar with the art to which this disclosure relates will recognize various alternative designs and embodiments for practicing the disclosure within the scope of the appended claims.

What is claimed is:

1. A thermally adaptive glazing panel roofing system, comprising:

a glazing panel including at least one notch formed in a side of the glazing panel;

two side brackets each including a ledge feature, wherein opposite sides of the glazing panel are supported by the ledge features;

at least one panel support plate attached to one of the ledge features and engaged to the notch; and a first pressure cap affixed to a first side bracket of the two side brackets and a second pressure cap affixed to a second side bracket of the two side brackets; and wherein the glazing panel is operable to thermally expand along the ledge features.

2. The system of claim 1, wherein the glazing panel includes two notches formed on the opposite sides of the glazing panel; and further comprising a pair of panel support plates engaged to the two notches.

3. The system of claim 2, wherein the two notches are formed at a bottom of the opposite sides of the glazing panel.

4. The system of claim 2, wherein the two notches are formed at a center portion of the opposite sides of the glazing panel.

5. The system of claim 1, wherein the glazing panel includes a first glazing panel;

wherein the first glazing panel includes a first pair of notches formed on the opposite sides of the first glazing panel; and further comprising:

a first pair of panel support plates attached to the ledge features and engaged to first pair of notches;

a second glazing panel including a second pair of notches formed on opposite sides of the second glazing panel; and a second pair of panel support plates attached to the ledge features and engaged to the second pair of notches.

6. The system of claim 5, wherein the first glazing panel includes a first cut-out portion along a bottom edge of the first glazing panel;

wherein the second glazing panel includes a second cut-out portion along a top edge of the second glazing panel; and wherein the first cut-out portion and the second cut-out portion are operable to overlap and to maintain an intact roofing surface while permitting the second glazing panel to thermally expand.

7. The system of claim 6, wherein the first glazing panel is operable to thermally expand in a direction away from the second glazing panel.

8. The system of claim 1, wherein the glazing panel is rectangle-shaped.

9. A thermally adaptive glazing panel roofing system, comprising:

a first rectangle-shaped glazing panel including a first pair of notches formed in opposite sides of the first glazing panel;

a second rectangle-shaped glazing panel including a second pair of notches formed in opposite sides of the second glazing panel;

two side brackets, each including a ledge feature, wherein opposite sides of the first rectangle-shaped glazing panel are supported by the ledge features and wherein opposite sides of the second rectangle-shaped glazing panel are supported by the ledge features;

a first pair of panel support plates, each attached to one of the ledge features and each engaged to one of the first pair of notches;

a second pair of panel support plates, each attached to one of the ledge features and each engaged to one of the second pair of notches; and a first pressure cap affixed to a first side bracket of the two side brackets and a second pressure cap affixed to a second side bracket of the two side brackets; and wherein the first rectangle-shaped glazing panel is disposed at a relatively higher position upon the two side brackets as compared to the second rectangle-shaped glazing panel; and wherein at least one of the first glazing panel and the second glazing panel is operable to thermally expand along the ledge features.

10. The system of claim 9, wherein the first rectangle-shaped glazing panel and the second rectangle-shaped glazing panel are operable to thermally expand along the ledge features.

11. The system of claim 9, wherein the first pair of notches are formed at a bottom of the opposite sides of the first rectangle-shaped glazing panel.

12. The system of claim 11, wherein the second pair of notches are formed at a bottom of the opposite sides of the second rectangle-shaped glazing panel.

13. The system of claim 9, wherein the first pair of notches are formed at a center portion of the opposite sides of the first rectangle-shaped glazing panel.

14. The system of claim 13, wherein the second pair of notches are formed at a center portion of the opposite sides of the second rectangle-shaped glazing panel.

15. The system of claim 9, the first rectangle-shaped glazing panel includes a first cut-out portion along a bottom edge of the first rectangle-shaped glazing panel;

wherein the second rectangle-shaped glazing panel includes a second cut-out portion along a top edge of the second rectangle-shaped glazing panel; and wherein the first cut-out portion and the second cut-out portion are operable to overlap and to maintain an intact roofing surface while permitting the second rectangle-shaped glazing panel to thermally expand.

16. The system of claim 15, wherein the first rectangle-shaped glazing panel is operable to thermally expand in a direction away from the second rectangle-shaped glazing panel.

* * * * *